US011187481B2

(12) United States Patent
Muska

(10) Patent No.: US 11,187,481 B2
(45) Date of Patent: Nov. 30, 2021

(54) FIREARM FIRE CONTROL MECHANISMS

(71) Applicant: Smith & Wesson Inc., Springfield, MA (US)

(72) Inventor: Simon M. Muska, Enfield, CT (US)

(73) Assignee: Smith & Wesson Inc., Springfield, MA (US)

( * ) Notice: Subject to any disclaimer, the term of this patent is extended or adjusted under 35 U.S.C. 154(b) by 65 days.

(21) Appl. No.: 16/877,808

(22) Filed: May 19, 2020

(65) Prior Publication Data

US 2020/0378709 A1 Dec. 3, 2020

Related U.S. Application Data

(60) Provisional application No. 62/854,024, filed on May 29, 2019.

(51) Int. Cl.

| | |
|---|---|
| ***F41A 17/42*** | (2006.01) |
| ***F41C 7/02*** | (2006.01) |
| ***F41A 19/45*** | (2006.01) |

(52) U.S. Cl.

CPC ..... *F41A 17/42* (2013.01); *F41A 19/45* (2013.01); *F41C 7/02* (2013.01)

(58) Field of Classification Search

CPC ..... F41A 17/42; F41A 17/40; F41A 19/45; F41C 7/02

See application file for complete search history.

(56) References Cited

U.S. PATENT DOCUMENTS

| | | | | |
|---|---|---|---|---|
| 1,626,867 A | | 5/1927 | Nelson | |
| 2,480,017 A | | 8/1949 | Green | |
| 2,549,797 A | | 4/1951 | Gaidos | |
| 2,719,375 A | | 10/1955 | Crittendon et al. | |
| 2,803,908 A | | 8/1957 | Raley | |
| 2,824,400 A | * | 2/1958 | Crittendon | F41A 21/485 42/16 |
| 3,292,492 A | | 12/1966 | Sturtevant | |
| 3,318,192 A | | 5/1967 | Miller et al. | |
| 3,670,442 A | | 6/1972 | Kennedy et al. | |
| 4,017,996 A | | 4/1977 | Liedke | |
| 6,272,783 B1 | * | 8/2001 | Dumortier | F41A 17/42 42/69.03 |
| 6,615,527 B1 | | 9/2003 | Martin | |
| 6,907,813 B2 | * | 6/2005 | Gablowski | F41A 17/32 89/148 |
| 7,802,511 B2 | * | 9/2010 | Doll | F41A 17/58 89/148 |
| 9,016,187 B2 | * | 4/2015 | Findlay | F41A 17/76 89/153 |

(Continued)

FOREIGN PATENT DOCUMENTS

| | | | | |
|---|---|---|---|---|
| EP | 3722732 A1 | * | 10/2020 | F41A 17/36 |

*Primary Examiner* — Joshua T Semick

(74) *Attorney, Agent, or Firm* — John Chionchio, Esq.; Ballard Spahr LLP

(57) ABSTRACT

Fire control mechanisms for a firearm include a trigger disconnect assembly and an action lock mechanism which work together to ensure safe and reliable firearm operation. The trigger disconnect uses a spring biased disconnector pivotably mounted on the trigger to actuate the sear and release a hammer sear upon firing. The hammer sear engages a compliant interface formed by a spring which actuates the action lock to unlock the bolt after the trigger has been pulled.

18 Claims, 8 Drawing Sheets

FIG. 5A

(56) References Cited

U.S. PATENT DOCUMENTS

| | | | | |
|---|---|---|---|---|
| 10,989,489 | B2 * | 4/2021 | Downey | F41A 17/52 |
| 2011/0185615 | A1 | 8/2011 | Gangl | |
| 2017/0328663 | A1 | 11/2017 | Fellows et al. | |
| 2018/0080730 | A1 | 3/2018 | Cook et al. | |
| 2020/0363153 | A1 * | 11/2020 | Franssen | F41A 17/58 |

* cited by examiner

FIREARM FIRE CONTROL MECHANISMS

CROSS REFERENCE TO RELATED APPLICATIONS

This application is based upon and claims benefit of priority to U.S. Provisional Application No. 62/854,024, filed May 29, 2019, the provisional application hereby incorporated by reference herein.

FIELD OF THE INVENTION

This invention relates to fire control mechanisms for firearms.

BACKGROUND

Two factors which are paramount in the operation of shotguns for self-defense are safety and reliability. Operational reliability requires sure coordination between the fire control mechanisms, namely the trigger and sear, and the action, which includes the bolt and action lock. The action lock must keep the bolt locked in battery during firing but allow release the bolt after firing to permit the spent round to be extracted and ejected and the next round to be stripped and chambered. The action lock must also be capable of manual operation, i.e., it must be unlockable independently of the fire control mechanism status to permit a live round to be extracted from the chamber. The fire control mechanisms and action must also be coordinated such that these two systems are never in a state which will: 1) allow an unintended discharge of the firearm, or 2) prevent an intended discharge. There is an opportunity to improve both the reliability and safety of firearm operation.

SUMMARY

On aspect of this invention concerns an action lock mechanism mountable on a receiver of a firearm for locking and unlocking an action of the firearm. In one example embodiment the action lock mechanism comprises a locking body mountable on the receiver. The locking body is movable between a locked position, wherein the locking body is engageable with the action to prevent movement thereof, and an unlocked position, wherein the locking body cannot engage the action thereby permitting motion of the action. A return spring acts between the locking body and the receiver. The return spring biases the locking body into the locked position. A disengagement spring is movably mountable on the receiver. The disengagement spring has a first portion engaging the locking body and a second portion. A force applied to the second portion of the disengagement spring is transmitted to the locking body for moving the locking body from the locked to the unlocked position.

In an example embodiment the locking body comprises a lever pivotably movable about a lever axis between the locked and the unlocked positions. Further by way of example, the return spring acts between the receiver and a point on the lever distal to the lever axis. In an example embodiment the disengagement spring comprises a coil spring rotatable about a spring axis. A first portion of the spring comprises a first leg extending away from the spring axis and having an end pivotably attached to the lever distal to the lever axis. A second portion of the spring comprises a second leg extending away from the spring axis. In an example embodiment the lever defines a notch therein. The notch is engageable with the action when the lever is in the locked position. A lever button is movably mountable on the receiver. The lever button is engageable with the locking body for moving the locking body from the locked to the unlocked position. A link connects the lever button to the lever at a point distal to the lever axis. Motion of the lever button pivots the lever from the locked to the unlocked position.

An example embodiment further comprises a hammer sear movably mountable within the receiver. The hammer sear is movable between a cocked and a released position. The hammer sear engages the second leg of the disengagement spring upon motion of the hammer sear into the released position for moving the lever into the unlocked position. By way of example a cam actuator is mountable on the action. The cam actuator is positioned to engage the notch when the lever is in the locked position.

The invention also encompasses a firearm. In an example embodiment according to the invention the firearm comprises a receiver. A barrel is mounted on the receiver. The barrel has a breech. An action is mounted on the receiver. The action comprises a bolt movable into and out of battery with the breech. An action lock mechanism is mounted on the receiver for locking and unlocking the action. In an example embodiment the action lock mechanism comprises a locking body mounted on the receiver and movable between a locked position, wherein the locking body is engageable with the action to prevent movement thereof out of battery, and an unlocked position, wherein the locking body cannot engage the action thereby permitting motion of the action out of battery. A return spring acts between the locking body and the receiver. The return spring biases the locking body into the locked position. A disengagement spring is movably mounted on the receiver. The disengagement spring has a first portion engaging the locking body and a second portion. A force applied to the second portion of the disengagement spring is transmitted to the locking body for moving the locking body from the locked to the unlocked position.

In an example embodiment, the locking body comprises a lever pivotably movable between the locked and the unlocked positions about a lever axis fixedly positioned within the receiver. The return spring acts between the receiver and a point on the lever distal to the lever axis in this example. Further by way of example, the disengagement spring comprises a coil spring rotatable about a spring axis fixedly positioned within the receiver. The first portion comprises a first leg extending away from the spring axis and having an end pivotably attached to the lever distal to the lever axis. The second portion comprises a second leg extending away from the spring axis. In a specific example embodiment the lever defines a notch therein. The notch is engageable with the action when the lever is in the locked position. This example may further comprise a lever button movably mounted on the receiver. The lever button is engageable with the locking body for moving the locking body from the locked to the unlocked position. The lever button is mounted on the receiver and movable relatively thereto. A link connects the lever button to the lever at a point distal to the lever axis. Motion of the lever button pivots the lever from the locked to the unlocked position.

An example firearm according to the invention may further comprise a hammer sear movably mounted within the receiver. The hammer sear is movable between a cocked and a released position. The hammer sear engages the second leg of the disengagement spring upon motion of the hammer sear into the released position for moving the lever into the unlocked position. A cam actuator is mounted on the action in this example. The cam actuator is positioned to engage the notch when the lever is in the locked position.

The invention also encompasses a trigger and disconnector assembly mountable on a receiver of a firearm. In an example embodiment the assembly comprises a trigger mountable on the receiver and pivotable about a trigger pivot axis. The trigger has a finger receiving portion projecting away from the trigger pivot axis and a horn projecting away from the trigger pivot axis. A disconnector body is mounted on the trigger between an end of the horn and the trigger pivot axis. The disconnector body is pivotable relatively to the trigger about a disconnector axis. The disconnector body defines a tail which projects away from the disconnector axis for engagement with the horn. The disconnector body defines a spur which projects away from the disconnector axis. A disconnector spring acts between the trigger and the disconnector body. The disconnector spring biases the tail into engagement with the horn. By way of example the disconnector spring comprises a coil spring. Further by way of example a trigger spring acts between the receiver and the trigger.

An example assembly according to the invention may further comprise a sear. In a specific example the sear comprises a sear body mountable on the receiver and pivotable relatively thereto about a sear pivot axis. A contact surface is defined by the sear body and is positioned distal to the sear pivot axis. The contact surface is engageable with the spur upon pivoting motion of the trigger about the trigger pivot axis which moves the horn toward the sear body. A back face is defined by the sear body and is positioned adjacent to the contact surface. The back face is engageable with the spur upon motion of the trigger about the trigger pivot axis which moves the horn away from the sear body. A sear spring acts between the sear body and the receiver. The sear spring biases the contact surface toward engagement with the spur. In an example embodiment the sear body defines an action surface positioned distal to the sear pivot axis and on an opposite side thereof from the contact surface.

An example assembly may further comprise a hammer sear. By way of example the hammer sear comprises an elongate body movably mountable within the receiver. A hammer spring acts between the receiver and the elongate body to bias the elongate body toward a muzzle end of the firearm. The elongate body defines a notch engageable with the action surface of the sear. The hammer spring biases the notch into engagement with the action surface of the sear.

The example trigger and disconnector assembly according to the invention may further comprise a disconnector cam positioned on the hammer sear. A cam follower is defined by the disconnector body. The cam follower projects away from the disconnector axis and is engageable with the disconnector cam upon motion of the hammer sear. In a specific example embodiment the elongate body defines a nose positioned at an end thereof distal to the hammer spring. The notch is positioned between the nose and the hammer spring in an example embodiment. The assembly may further comprise an action lock mechanism mountable on the receiver for locking and unlocking an action of the firearm. In an example embodiment he action lock mechanism comprises a locking body mountable on the receiver and movable between a locked position, wherein the locking body is engageable with the action to prevent movement thereof, and an unlocked position, wherein the locking body cannot engage the action thereby permitting motion of the action. A return spring acts between the locking body and the receiver. The return spring biases the locking body into the locked position. A disengagement spring is movably mountable on the receiver. The disengagement spring has a first portion engaging the locking body and a second portion engageable by the nose of the elongate body. A force applied to the second portion of the disengagement spring by the nose is transmitted to the locking body for moving the locking body from the locked to the unlocked position.

The invention further encompasses a firearm. An example firearm according to the invention comprises a receiver. A barrel is mounted on the receiver. The barrel has a breech. An action is mounted on the receiver. The action comprises a bolt movable into and out of battery with the breech. A trigger and disconnector assembly is mounted on the receiver. In an example embodiment the assembly comprises a trigger mounted on the receiver and pivotable about a trigger pivot axis. The trigger has a finger receiving portion projecting away from the trigger pivot axis and a horn projecting away from the trigger pivot axis. A disconnector body is mounted on the trigger between an end of the horn and the trigger pivot axis. The disconnector body is pivotable relatively to the trigger about a disconnector axis. The disconnector body defines a tail which projects away from the disconnector axis for engagement with the horn. The disconnector body defines a spur which projects away from the disconnector axis. A disconnector spring acts between the trigger and the disconnector body. The disconnector spring biases the tail into engagement with the horn. In an example embodiment, the disconnector spring comprises a coil spring. By way of further example, a trigger spring acts between the receiver and the trigger.

An example firearm may further comprise a sear. By way of example the sear comprises a sear body mounted on the receiver and pivotable relatively thereto about a sear pivot axis. A contact surface is defined by the sear body and is positioned distal to the sear pivot axis. The contact surface is engageable with the spur upon pivoting motion of the trigger about the trigger pivot axis which moves the horn toward the sear body. A back face is defined by the sear body and is positioned adjacent to the contact surface. The back face is engageable with the spur upon motion of the trigger about the trigger pivot axis which moves the horn away from the sear body. A sear spring acts between the sear body and the receiver. The sear spring biases the contact surface into engagement with the spur. In an example embodiment the sear body defines an action surface positioned distal to the sear pivot axis and on an opposite side thereof from the contact surface.

A firearm according to the invention may further comprise a hammer sear. By way of example the hammer sear comprises an elongate body movably mountable within the receiver. A hammer spring acts between the receiver and the elongate body to bias the elongate body toward a muzzle end of the firearm. The elongate body defines a notch engageable with the action surface of the sear. The hammer spring biases the notch into engagement with the action surface of the sear. A disconnector cam is positioned on the hammer sear. A cam follower is defined by the disconnector body. The cam follower projects away from the disconnector axis and is engageable with the disconnector cam upon motion of the hammer sear. In a further example embodiment the elongate body defines a nose positioned at an end thereof distal to the hammer spring. The notch is positioned between the nose and the hammer spring in an example embodiment.

An example firearm according to the invention may further comprise an action lock mechanism mountable on the receiver for locking and unlocking the action of the firearm. In an example embodiment the action lock mechanism comprises a locking body mounted on the receiver and movable between a locked position, wherein the locking body is engageable with the action to prevent movement thereof, and an unlocked position, wherein the locking body cannot engage the action thereby permitting motion of the action. A return spring acts between the locking body and the receiver. The return spring biases the locking body into the locked position. A disengagement spring is movably mounted on the receiver. The disengagement spring has a first portion engaging the locking body and a second portion engageable by the nose of the elongate body. A force applied to the second portion of the disengagement spring by the nose is transmitted to the locking body for moving the locking body from the locked to the unlocked position.

BRIEF DESCRIPTION OF THE DRAWINGS

FIGS. 4 and 4A are sectional side views of a portion of the firearm shown in FIG. 2 just prior to sear off;

FIGS. 5 and 5A are sectional side views of a portion of the firearm shown in FIG. 2 after firing with the action lock disconnected and the action in battery;

DETAILED DESCRIPTION

Figure 1:
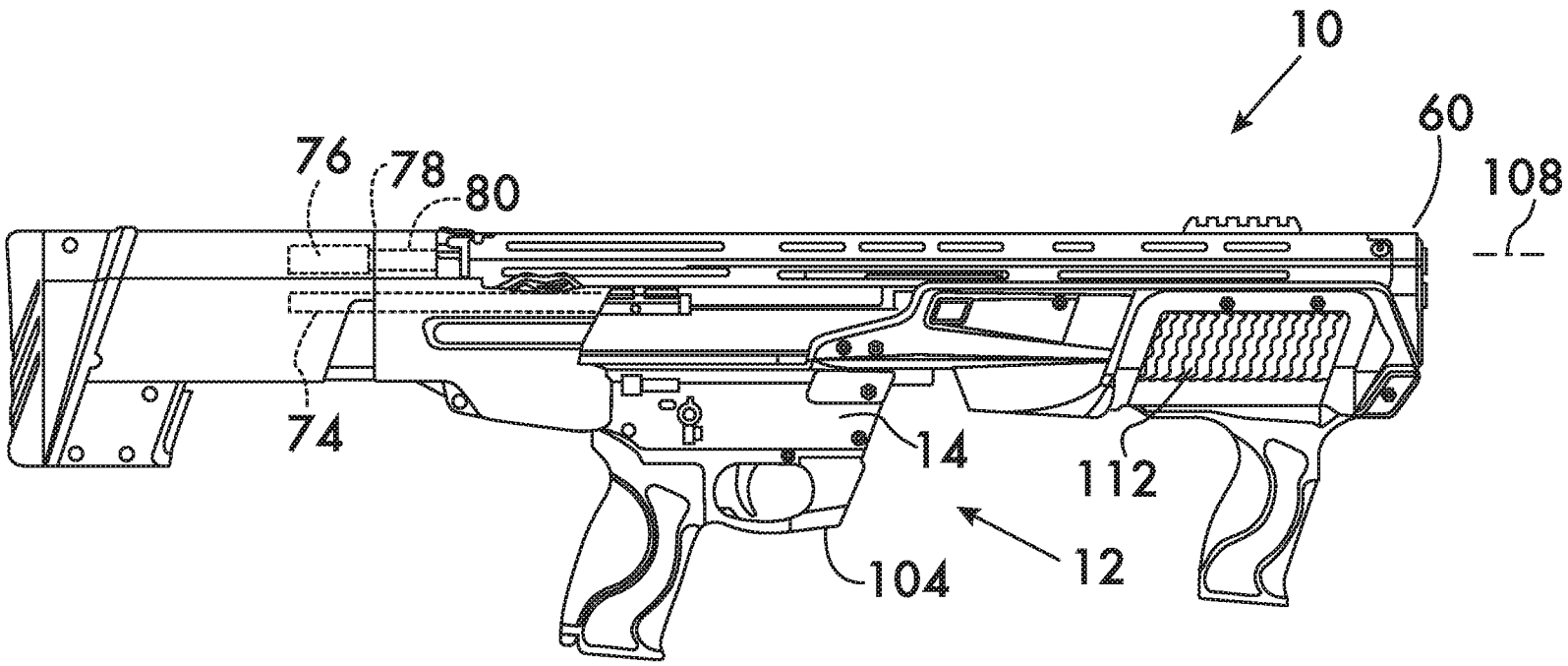
FIG. 1 is a side view of an example firearm, a shotgun in a bullpup configuration, having fire control mechanisms according to the invention.
Figure 2:
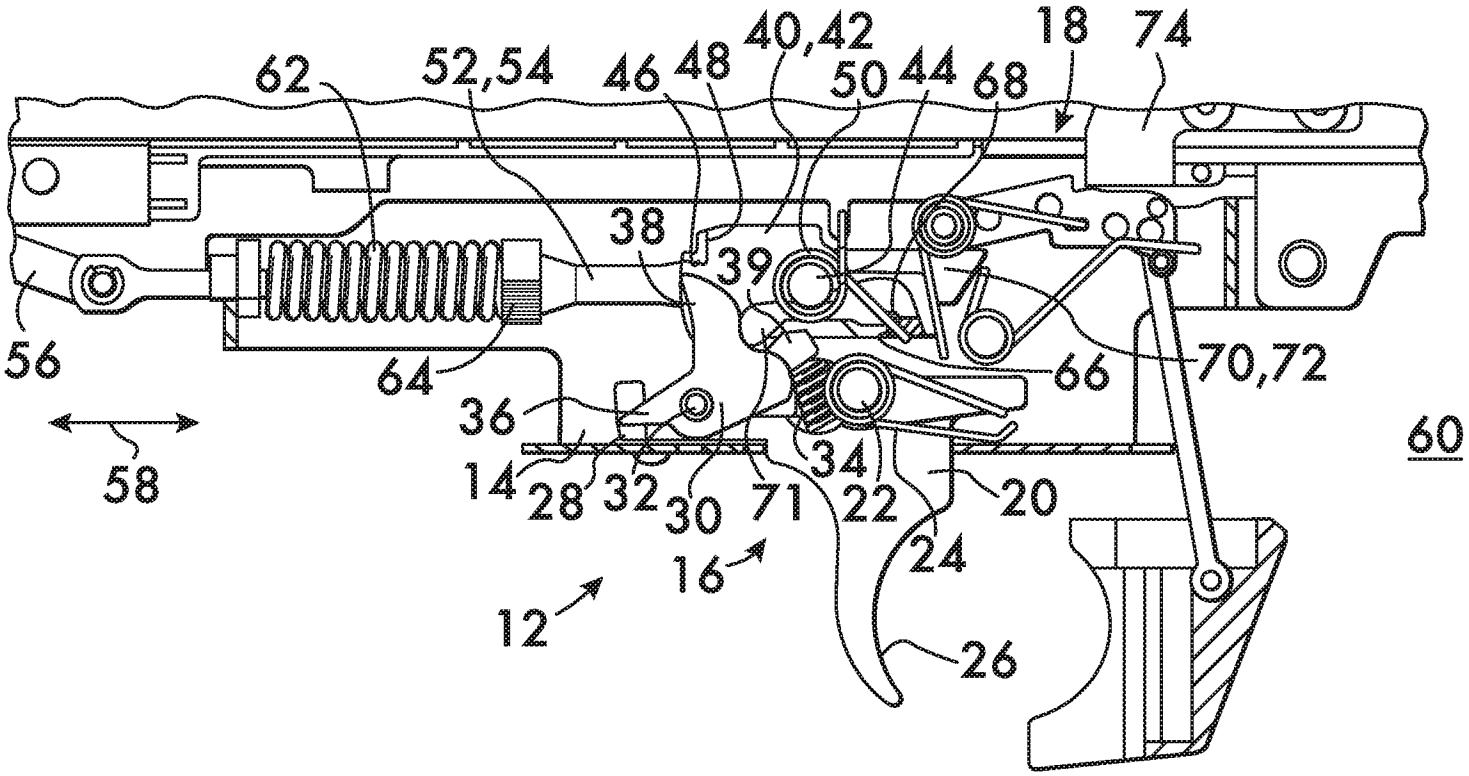
FIG. 2 is a sectional side view of a portion of the firearm shown in FIG. 1 illustrating an example trigger and disconnector assembly and an action lock mechanism according to the invention.

FIG. 1 shows a firearm 10, in this example, a shotgun in a "bullpup" configuration, having a fire control system 12 according to the invention. FIG. 2 shows a partial cut-away side view of the firearm's receiver 14, which houses the fire control system 12. The example system 12 comprises a trigger and disconnector assembly 16 and an action lock mechanism 18.

In this example embodiment the trigger and disconnector assembly 16 comprises a trigger 20 mounted in the receiver 14 and pivotable about a trigger pivot axis 22. Trigger 20 is biased about axis 22 in a counterclockwise direction (all rotations herein specified with respect to the figures) by a trigger spring 24 which acts between the receiver 14 and the trigger 20. Trigger 20 comprises a finger receiving portion 26 and a horn 28, both of which project away from the trigger pivot axis 22. A disconnector body 30 is mounted on trigger 20 between the end of horn 28 and the trigger pivot axis 22. Disconnector body 30 is pivotable relative to trigger 20 about a disconnector axis 32 oriented parallel to the trigger pivot axis 22. Disconnector body 30 is biased in a counterclockwise direction about disconnector axis 32 by a disconnector spring 34 which acts between the trigger 20 and the disconnector body. In this example embodiment the disconnector spring 34 comprises a coil spring which acts upon a plunger which bears on the disconnector body to provide the bias load. Disconnector body 30 defines a tail 36 which projects away from the disconnector axis 32 and engages the horn 28. Being biased counterclockwise by the disconnector spring 34, the tail 36 is biased into engagement with the horn 28. Disconnector body 30 further defines a spur 38 and a cam follower 39, both of which project away from the disconnector axis 32.

Fire control system 12 may further comprise a sear 40. In this example embodiment, sear 40 comprises a sear body 42 mounted on receiver 14 and pivotable about a sear pivot axis 44 oriented parallel to the trigger pivot axis 22. Sear body 42 defines a contact surface 46 positioned distal to the sear pivot axis 44. Contact surface 46 is engageable with the spur 38 of the disconnector body 30 upon pivoting motion of the trigger 20 about the trigger pivot axis 22 which moves the horn 28 toward the sear body 42. A back face 48 is also defined by the sear body. Back face 48 is positioned adjacent to the contact surface 46. The back face 48 is engageable with the spur 38 upon motion of the trigger 20 about the trigger pivot axis 22 which moves the horn 28 away from the sear body 42. The purpose of back face 48 is to hold spur 38 in a disconnected position until such a time as the trigger 20 is returned to the set position. At some time prior to the completion of the trigger 20 being returned to the set position, the disconnector body 30 will be able to rotate counterclockwise such that tail 36 contacts trigger horn 28, as disconnector spur 38 will be geometrically clear of back face 48. A sear spring 50 acts between the sear body 42 and the receiver 14 and biases the sear body in a counterclockwise direction about the sear pivot axis 44 and toward engagement with the spur 38.

Trigger and disconnector assembly 16 may also comprise a hammer sear 52. In this example embodiment the hammer sear 52 comprises an elongate body 54 movably mounted within the receiver 14. The elongate body 54 is connected to a hammer (not shown) via a link 56. The hammer sear 52 is movable relatively to the receiver 14 in a direction parallel to its length as shown by arrow 58. The hammer sear 52 is biased toward the muzzle end 60 of firearm 10 (see also FIG. 1) by a hammer spring 62 acting between the receiver 14 and the elongate body 54 via a bushing 64 on the hammer sear. Sear body 42 comprises an action surface 66 positioned on an opposite side of the sear pivot axis 44 from the sear contact surface 46. Action surface 66 is engageable with a notch 68 defined by the hammer sear 52. The hammer sear 52 (and thus the hammer) is held in the "cocked" position (hammer spring 62 compressed) by engagement between the sear action surface 66 and the notch 68 of the hammer sear 52. As described below, pivoting motion of the sear body 42 about the sear pivot axis 44 will release the hammer sear 52 to release the hammer and fire the firearm 10. Spur 38 engages the contact surface 46 of the sear body 42 when the trigger 20 pivots clockwise about the trigger pivot axis 22 when the trigger 20 is pulled.

The elongate body 54 of hammer sear 52 also defines a nose 70 positioned at an end 72 thereof distal to the hammer spring 62. Notch 68 in this example is positioned between the nose 70 and the hammer spring 62. The nose 70 interacts with the action lock mechanism 18 also encompassed by the invention. A disconnection cam 71 is positioned on the underside of the hammer sear 52 where it may engage the cam follower 39 projecting from the disconnector body 30. Interaction between the disconnection cam 71 and the disconnector's cam follower 39 disconnects the sear body 42 from the trigger 20 to permit resetting of the action as described below.

Figure 3:
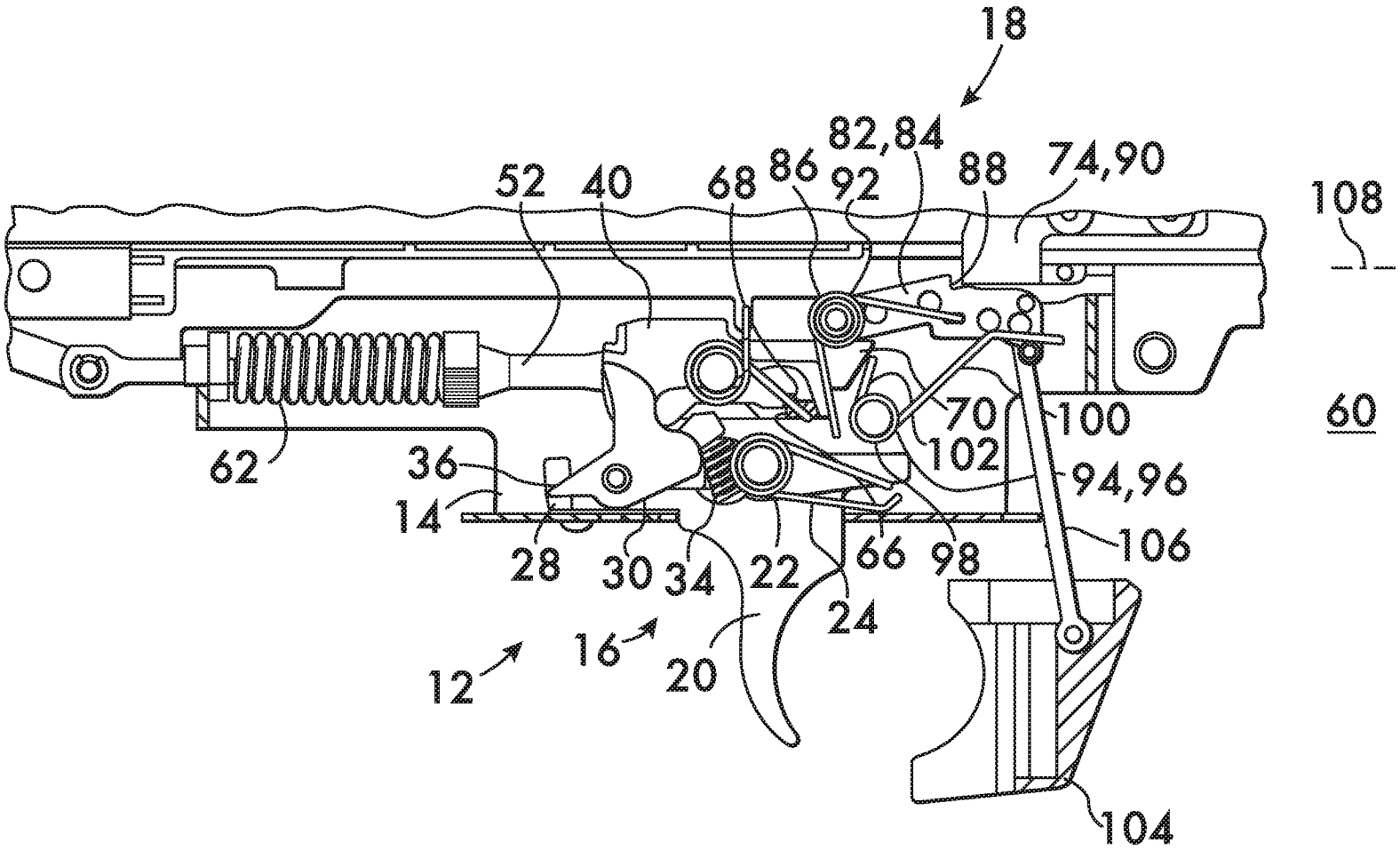
FIG. 3 is a sectional side view of a portion of the firearm shown in FIG. 2 ready to fire.

The example action lock mechanism 18 shown is mounted on the receiver 14 for locking and unlocking the action 74 of the firearm 10. As shown in FIG. 1, action 74 includes a bolt 76 movable into and out of battery with a breech 78 of a barrel 80 mounted on the receiver 14. As shown in FIG. 3, an example action lock mechanism 18 according to the invention comprises a locking body 82 mounted on the receiver 14. As shown, the locking body 82 may comprise a lever 84 pivotably movable about a lever axis 86 oriented parallel to the trigger pivot axis 22. Motion of the lever 84 is between a locked position (shown), wherein the locking body 82 is engageable with the action 74 to prevent movement thereof, and an unlocked position (see FIG. 5), wherein the locking body 82 (lever 84) cannot engage the action 74, thereby permitting its motion. With reference again to FIG. 3, it is advantageous if the lever 84 defines a notch 88 therein. The notch 88 is engageable with a cam actuator 90 mounted on the action 74. The cam actuator 90 is positioned to engage the notch 88 when the lever 84 is in the locked position and thereby provide positive mechanical engagement between the lever and the action when the action 74 is to be locked.

Lever 84 is biased in a counterclockwise direction by a return spring 92 acting between the receiver 14 and the lever. Advantageously, the return spring 92 acts at a point on lever 84 distal to the lever axis 86. Lever 84 is further pivotable in a clockwise direction by a disengagement spring 94. In this example, disengagement spring 94 comprises a coil spring 96 mounted on receiver 14 which rotates freely about a spring axis 98 oriented parallel to trigger pivot axis 22. Disengagement spring 94 has a first arm 100 which extends away from the spring axis 98 and acts on the lever 84. First arm 100 is advantageously pivotably attached to the lever 84 distal to the lever axis 86. Disengagement spring 94 also has a second arm 102, which extends away from the spring axis 98 and is acted upon by the nose 70 of the hammer sear 52. When the hammer sear 52 is released and moves toward the muzzle end 60 of the firearm 10 under the force of the hammer spring 62, the nose 70 of the hammer sear 52 engages the second arm 102 of the disengagement spring 94. Because the disengagement spring 94 is free to rotate about spring axis 98, the force of the hammer sear 52 on the second arm 102 is transmitted to the first arm 100 of the disengagement spring 94 which acts on the lever 84 and pivots it in the clockwise direction and into the unlocked position as described below.

The lever 84 is also manually pivotable by a lever button 104, shown in FIG. 1. As shown in FIG. 3, lever button 104 is movably mounted on the receiver 14 and pivotably connected to the lever 84 by a link 106. Motion of the lever button 104 which places the link 106 in compression or tension will pivot the lever 84 about lever axis 86. In this example embodiment, the lever button 104 is constrained to move transversely to both the firing axis 108 of the firearm 10 and the trigger pivot axis 22. When the lever 84 is in the position shown in FIGS. 1 and 3, it will prevent movement of the action 74, thereby preventing the action from cycling and the breech 78 from opening. Pulling on lever button 104 will pivot the lever 84 clockwise about lever axis 86, preventing the notch 88 from engaging the cam actuator 90 and thereby allowing the action 74 to be cycled, for example, to open the breech and clear a chambered cartridge.

Operation of firearm 10 is described with reference to FIGS. 3-7. FIG. 3 shows the fire control system 12 ready to fire. The hammer (not shown) is cocked as evidenced by the compressed hammer spring 62, the notch 68 of the hammer sear 52 engaging the action surface 66 of the sear 40, the sear thereby holding the hammer cocked. The lever 84 is pivoted counterclockwise by its return spring 92 so its notch 88 will engage the cam actuator 90 and prevent the action 74 from opening during firing. Trigger 20 is biased into the "set" position by trigger spring 24 and the disconnector body 30 is biased by disconnector spring 34 so that the tail 36 engages the horn 28 of the trigger.

Figure 4:
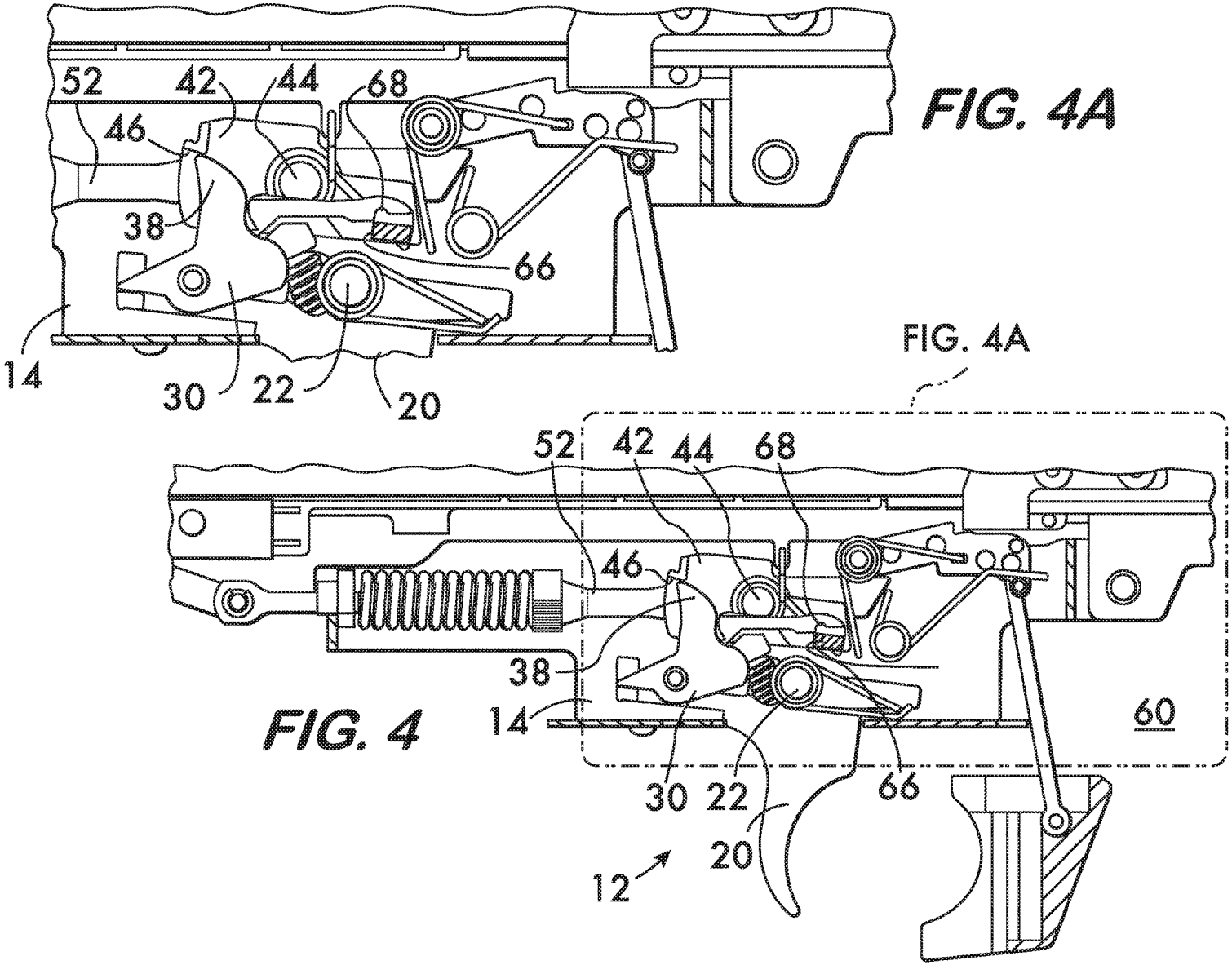

FIGS. 4 and 4A show fire control system 12 just prior to "sear off", release of the hammer sear 52. Trigger 20 is being pulled and pivots clockwise about trigger pivot axis 22. As the trigger 20 pivots, the spur 38 of the disconnector body 30 is brought into engagement with the contact surface 46 of the sear body 42. As the trigger 20 continues to pivot, engagement of the spur 38 with the contact surface 46 pivots sear body 42 clockwise about sear pivot axis 44 thereby moving the sear's action surface 66 relatively to the hammer sear 52 so that the notch 68 of the hammer sear engages the action surface 66 just on the verge of release.

Figure 5:
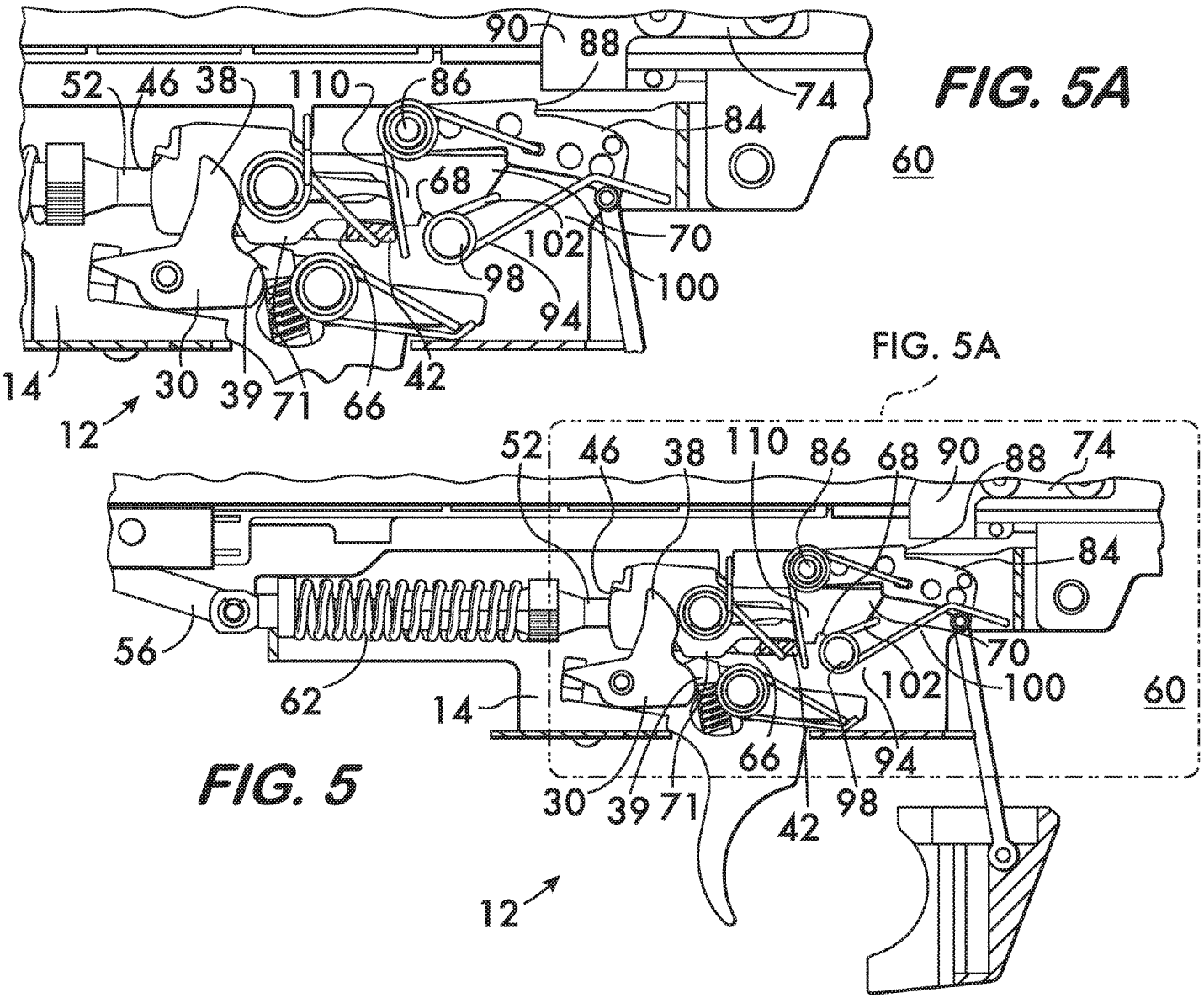
Figure 6:
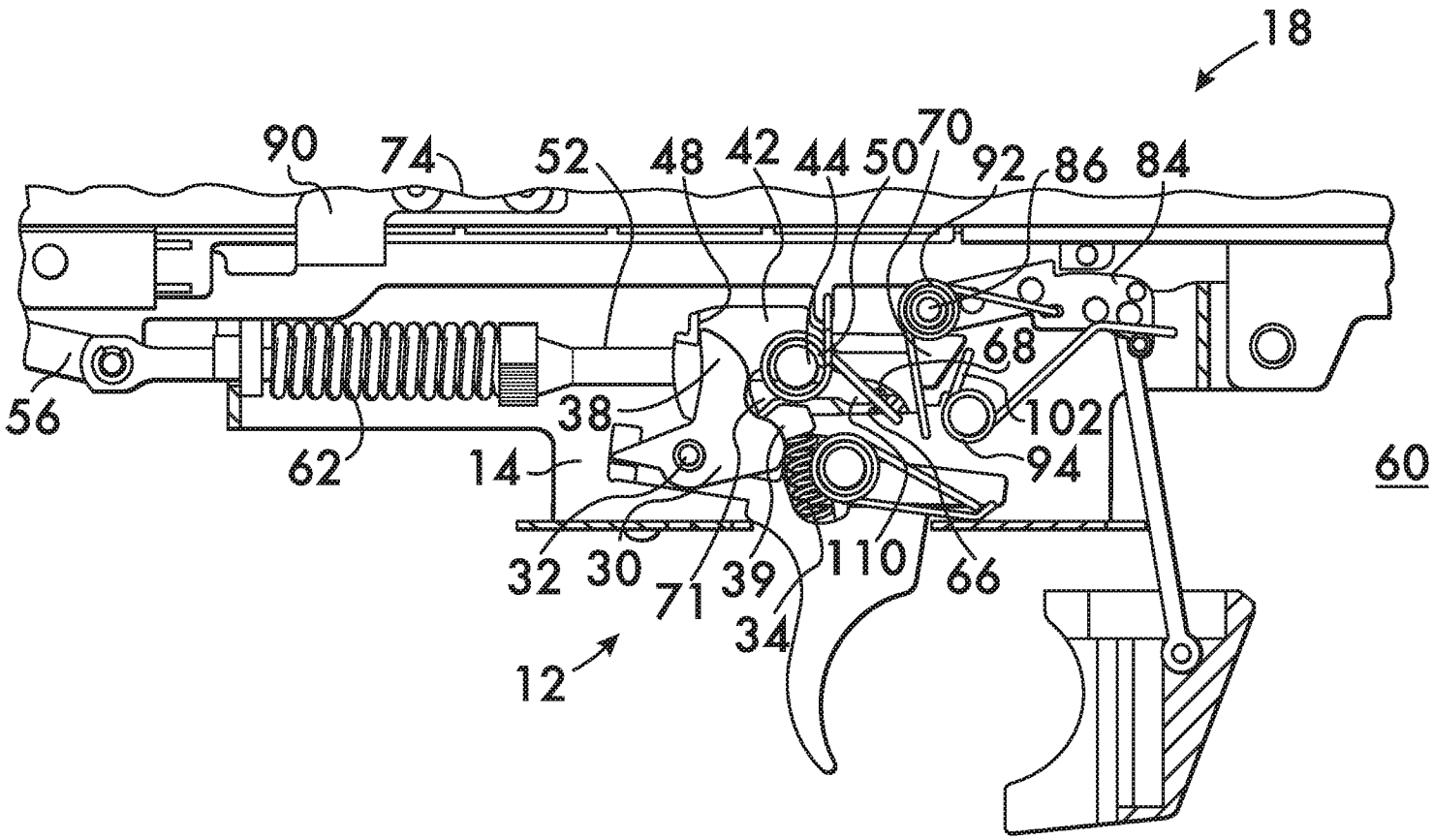
FIG. 6 is a sectional side view of a portion of the firearm shown in FIG. 2 with the action out of battery.

FIGS. 5 and 5A show fire control system 12 after firing. Hammer sear 52 has moved toward the muzzle end 60 of the firearm 10 under the biasing force of hammer spring 62, releasing the hammer (not shown) via link 56 to discharge a chambered round. Motion of the hammer sear 52 also causes the nose 70 of the hammer sear to engage the second arm 102 of the disengagement spring 94. Because the disengagement spring 94 is free to rotate about spring axis 98, the force applied to the second arm 102 is transferred to the first arm 100, which pivots the lever 84 clockwise about its lever axis 86. This prevents the lever notch 88 from engaging the cam actuator 90 and thus, as shown in FIG. 6, allows the action 74 to be opened (moved away from the muzzle end 60) to extract a spent cartridge from the chamber (not shown) as well as cock the hammer. If the firearm is a shotgun as shown in FIG. 1, it is well known to connect a sliding fore stock 112 to the action 74 to permit the action to be opened and closed (moved away from and toward the muzzle end 60) using the "weak hand" supporting the fore stock.

As shown in FIG. 5, upon release of the hammer sear 52 via rotation of the sear body 42, the hammer sear advances toward the muzzle end 60 due to the load of the hammer spring 62. The hammer sear disconnector cam 71, which projects from the underside of the hammer sear, contacts the cam follower 39 projecting from the disconnector body 30 thereby rotating the disconnector body clockwise. The clockwise rotation of the disconnector body 30 separates the spur 38 from contact surface 46. The sear body 42 then rotates counterclockwise under influence of the sear spring 50 until it contacts the hammer sear. As the hammer sear 52 is drawn away from muzzle end 60 by the cycling of the action 74 a cam surface 110 adjacent to the notch 68 engages the sear body 42 and allows the notch to move into position adjacent to the action surface 66. Once notch 68 of the hammer sear moves to the left of the sear's action surface 66, the sear body 42 moves further counterclockwise into a capture position with the hammer sear 52, resetting the notch 68 with the action surface 66 of the sear body 42 as shown in FIG. 6 and described further below.

Figure 7:
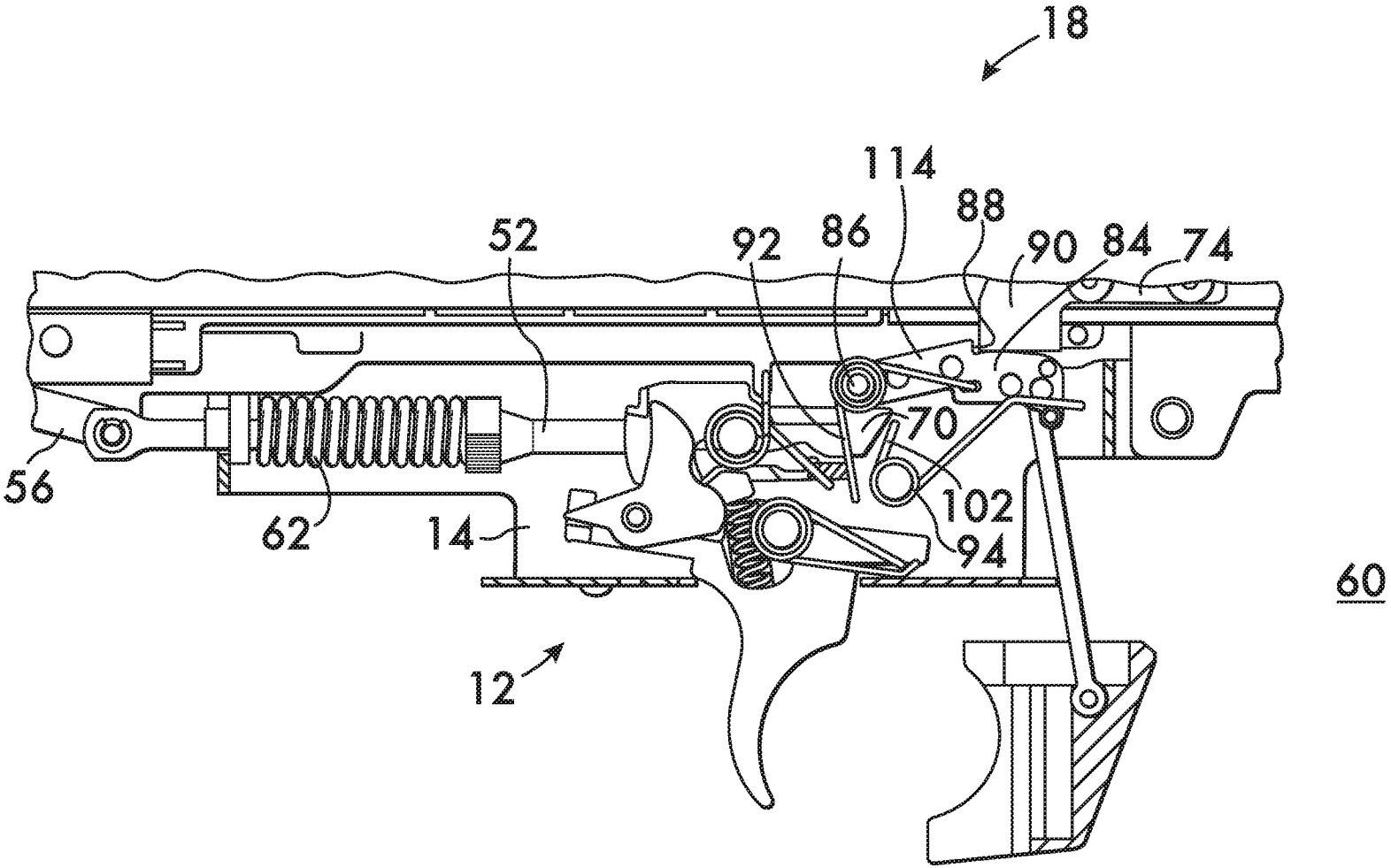
FIG. 7 is a sectional side view of a portion of the firearm shown in FIG. 2 with the action returned to battery.

FIG. 6 further shows the hammer sear 52 drawn back away from the muzzle end 60 and compressing the hammer spring 62 (via the action 74 operating on the hammer, not shown, transmitting force to the hammer sear via the link 56). As the hammer sear 52 moves back away from the muzzle end 60, the cam follower 39 of disconnector body 30 falls off of the hammer sear's disconnection cam 71 which allows the disconnector body to rotate counterclockwise about disconnector axis 32 under the force of disconnector spring and plunger 34 and engage the spur 38 with the sear back face 48. Motion of the hammer sear 52 also disengages its nose 70 from the second arm 102 of disengagement spring 94 allowing the lever 84 to pivot about lever axis 86 under the biasing force of the return spring 92 so that its notch 88 may again engage the cam actuator 90 once the action is closed, as shown in FIG. 7. Note that a ramp surface 114 on the lever 84 permits the action 74 to engage and pivot the lever 84 clockwise about lever axis 86 as the action 74 passes over it upon closing, the return spring 92 restoring the lever 84 to its engagement position.

Figure 8:
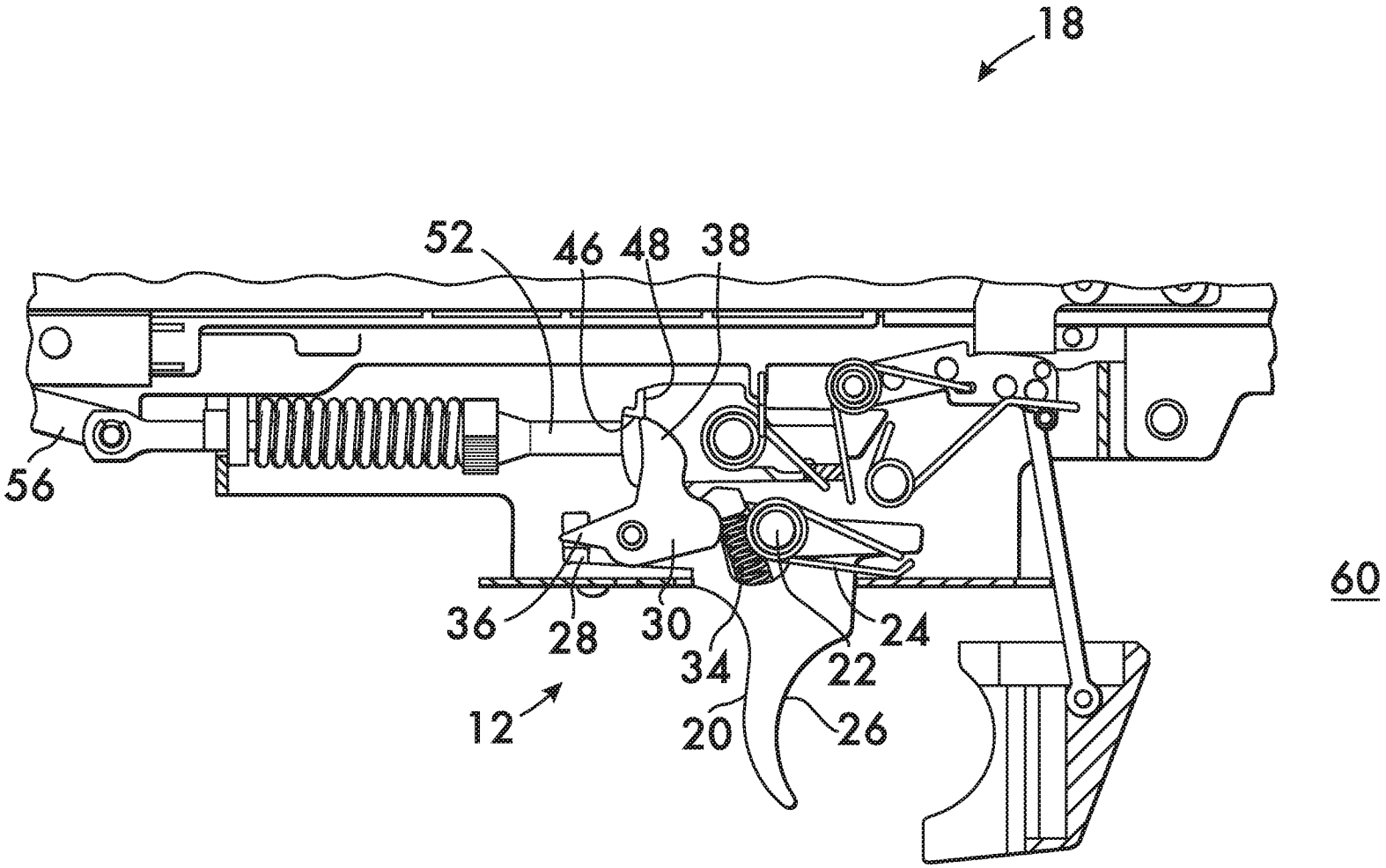
FIG. 8 is a sectional side view of a portion of the firearm shown in FIG. 2 illustrating reset of the trigger and disconnector assembly.

FIG. 8 illustrates trigger reset wherein pressure is let off the finger receiving portion 26 of trigger 20 and the trigger spring 24 pivots the trigger counterclockwise about trigger pivot axis 22 to return the trigger to the "set position shown in FIG. 3. As the trigger 20 pivots, the disconnector body 30, mounted on the trigger, rides along. The disconnector body 30 is biased counterclockwise by disconnector spring and plunger 34 which causes the spur 38 to drag across the back face 48 of the sear contact surface 46 as the trigger 20 pivots counterclockwise. Once the trigger 20 has rotated far enough such that the spur 38 is geometrically clear of the back face 48, the spur falls off of the back face and is positioned as shown in FIG. 3 with its tail 36 against the horn 28 and the spur 38 ready to again engage the contact surface 46 of sear body 42 upon the next trigger pull.

Of interest in fire control system 12 is the engagement of the nose 70 of hammer sear 52 against a compliant body such as the second arm 102 of the rotatable disengagement spring 94 to effect disengagement of the notch 88 of the lever 84 from the cam actuator 90 of the action 74. A compliant interface between the hammer sear 52 and the lever 84 is advantageous because if there were a more rigid interface then motion of the hammer sear might be prevented even when the trigger was pulled. This could happen, for example, if the cam actuator 90 were held with force against the notch 88 of the lever 84. This could occur if the shooter drew back forcefully on the fore stock while pulling the trigger. Pivoting of the trigger would rotate the sear and release the hammer sear, which would not be able to move because of a rigid interface between the hammer sear 52 and the lever 84, which cannot move because it is held by the interaction between the notch 88 and the cam actuator 90. However, if the force on the fore stock was then released the lever 86 would be able to move, thereby releasing the hammer sear 52 and unexpectedly discharging the firearm. In another scenario to be avoided, if the shooter were to apply force against the lever button 104 while the trigger is pulled, the lever 84 would remain in position and prevent motion of the hammer sear 52 due to the rigid interface between it and the lever 84 despite rotation of the sear body 42 releasing the hammer sear 52. The firearm would discharge unexpectedly however once the force was removed from the lever button 104, thereby permitting motion of the lever 84. A compliant interface between the sear hammer 52 and the lever 84 prevents such unexpected discharges by allowing the sear hammer 52 to move upon the pull of the trigger regardless of the state of the cam actuator-notch interface or the lever button 104.

What is claimed is:

1. An action lock mechanism mountable on a receiver of a firearm for locking and unlocking an action of said firearm, said action lock mechanism comprising:

a locking body mountable on said receiver and movable between a locked position, wherein said locking body is engageable with said action to prevent movement thereof, and an unlocked position wherein said locking body cannot engage said action thereby permitting motion of said action;

a return spring acting between said locking body and said receiver, said return spring biasing said locking body into said locked position;

a disengagement spring movably mountable on said receiver, said disengagement spring having a first portion engaging said locking body and a second portion; wherein a force applied to said second portion of said disengagement spring is transmitted to said locking body for moving said locking body from said locked to said unlocked position.

2. The mechanism according to claim 1, wherein said locking body comprises a lever pivotably movable about a lever axis between said locked and said unlocked positions.

3. The mechanism according to claim 2, wherein said return spring acts between said receiver and a point on said lever distal to said lever axis.

4. The mechanism according to claim 2, wherein said disengagement spring comprises a coil spring rotatable about a spring axis, said first portion comprising a first leg extending away from said spring axis and having an end pivotably attached to said lever distal to said lever axis, said second portion comprising a second leg extending away from said spring axis.

5. The mechanism according to claim 2, wherein said lever defines a notch therein, said notch being engageable with said action when said lever is in said locked position.

6. The mechanism according to claim 1, further comprising a lever button movably mountable on said receiver, said lever button being engageable with said locking body for moving said locking body from said locked to said unlocked position.

7. The mechanism according to claim 2, further comprising:

a lever button mountable on said receiver and movable relatively thereto;

a link connecting said lever button to said lever at a point distal to said lever axis, whereby motion of said lever button pivots said lever from said locked to said unlocked position.

8. The mechanism according to claim 4, further comprising a hammer sear movably mountable within said receiver, said hammer sear being movable between a cocked and a released position, said hammer sear engaging said second leg of said disengagement spring upon motion of said hammer sear into said released position for moving said lever into said unlocked position.

9. The mechanism according to claim 5, further comprising a cam actuator mountable on said action, said cam actuator positioned to engage said notch when said lever is in said locked position.

10. A firearm, said firearm comprising:

a receiver;

a barrel mounted on said receiver, said barrel having a breech;

an action mounted on said receiver, said action comprising a bolt movable into and out of battery with said breech;

an action lock mechanism mounted on said receiver for locking and unlocking said action, said action lock mechanism comprising:

a locking body mounted on said receiver and movable between a locked position, wherein said locking body is engageable with said action to prevent movement thereof out of battery, and an unlocked position wherein said locking body cannot engage said action thereby permitting motion of said action out of battery;

a return spring acting between said locking body and said receiver, said return spring biasing said locking body into said locked position;

a disengagement spring movably mounted on said receiver, said disengagement spring having a first portion engaging said locking body and a second portion; wherein a force applied to said second portion of said disengagement spring is transmitted to said locking body for moving said locking body from said locked to said unlocked position.

11. The firearm according to claim 10, wherein said locking body comprises a lever pivotably movable between said locked and said unlocked positions about a lever axis fixedly positioned within said receiver.

12. The firearm according to claim 11, wherein said return spring acts between said receiver and a point on said lever distal to said lever axis.

13. The firearm according to claim 11, wherein said disengagement spring comprises a coil spring rotatable about a spring axis fixedly positioned within said receiver, said first portion comprising a first leg extending away from said spring axis and having an end pivotably attached to said lever distal to said lever axis, said second portion comprising a second leg extending away from said spring axis.

14. The firearm according to claim 11, wherein said lever defines a notch therein, said notch being engageable with said action when said lever is in said locked position.

15. The firearm according to claim 10, further comprising a lever button movably mounted on said receiver, said lever button being engageable with said locking body for moving said locking body from said locked to said unlocked position.

16. The firearm according to claim 11, further comprising:

a lever button mounted on said receiver and movable relatively thereto;

a link connecting said lever button to said lever at a point distal to said lever axis, whereby motion of said lever button pivots said lever from said locked to said unlocked position.

17. The firearm according to claim 13, further comprising a hammer sear movably mounted within said receiver, said hammer sear being movable between a cocked and a released position, said hammer sear engaging said second leg of said disengagement spring upon motion of said hammer sear into said released position for moving said lever into said unlocked position.

18. The firearm according to claim 14, further comprising a cam actuator mounted on said action, said cam actuator positioned to engage said notch when said lever is in said locked position.

* * * * *